US012330075B2

(12) United States Patent
Beutler

(10) Patent No.: US 12,330,075 B2
(45) Date of Patent: Jun. 17, 2025

(54) TOWING VEHICLE

(71) Applicant: Jörg Beutler, Holzkirchen (DE)

(72) Inventor: Jörg Beutler, Holzkirchen (DE)

( * ) Notice: Subject to any disclaimer, the term of this patent is extended or adjusted under 35 U.S.C. 154(b) by 838 days.

(21) Appl. No.: 17/463,095

(22) Filed: Aug. 31, 2021

(65) Prior Publication Data

US 2022/0062779 A1 Mar. 3, 2022

(51) Int. Cl.

| | |
|---|---|
| ***A63G 3/00*** | (2006.01) |
| ***A63G 1/28*** | (2006.01) |
| ***A63G 21/04*** | (2006.01) |
| ***A63G 21/14*** | (2006.01) |
| ***A63G 21/18*** | (2006.01) |
| ***B63B 21/56*** | (2006.01) |
| *A63G 31/00* | (2006.01) |
| *A63G 31/06* | (2006.01) |

(52) U.S. Cl.

CPC ..... *A63G 3/00* (2013.01); *A63G 1/28* (2013.01); *A63G 21/04* (2013.01); *A63G 21/14* (2013.01); *A63G 21/18* (2013.01); *B63B 21/56* (2013.01); *A63G 31/007* (2013.01); *A63G 31/06* (2013.01); *B63B 2021/566* (2013.01)

(58) Field of Classification Search

CPC ..... A63G 21/04; A63G 21/14; A63G 1/20; A63G 3/00; B63B 21/56

USPC ..... 104/53

See application file for complete search history.

(56) References Cited

U.S. PATENT DOCUMENTS

| | | | | |
|---|---|---|---|---|
| 7,437,998 | B2 * | 10/2008 | Burger | A63G 3/00 104/23.1 |
| 7,685,944 | B2 * | 3/2010 | Kilbert | A63G 21/08 104/53 |
| 10,881,973 | B2 * | 1/2021 | Swasey | A63G 21/08 |
| 11,491,409 | B2 * | 11/2022 | Beutler | A63G 31/02 |
| 11,654,374 | B2 * | 5/2023 | Brister | A63G 1/24 472/43 |
| 2009/0266266 | A1 | 10/2009 | Kilbert et al. | |
| 2016/0332084 | A1 | 11/2016 | McVeen et al. | |
| 2020/0215440 | A1 | 7/2020 | Brister et al. | |
| 2021/0346814 | A1 * | 11/2021 | Harrington | A63G 3/00 |

FOREIGN PATENT DOCUMENTS

| | | | |
|---|---|---|---|
| DE | 202018105473 U1 * | 12/2018 | A63G 21/04 |
| EP | 1 671 686 | 6/2006 | |
| EP | 3 626 322 | 3/2020 | |
| WO | 2011/039335 | 4/2011 | |

OTHER PUBLICATIONS

Search Report for EP Application No. 20193885.9 dated Feb. 26, 2021, 8 pages.

* cited by examiner

*Primary Examiner* — Zachary L Kuhfuss
*Assistant Examiner* — Heaven R Buffington
(74) *Attorney, Agent, or Firm* — NIXON & VANDERHYE

(57) ABSTRACT

A system for transporting passengers has a drive unit and a vehicle that is pulled by the drive unit. The drive unit includes a stationary guiding device like a rail which is arranged laterally at a distance and above at a height relative to the vehicle. The drive unit also includes a bogie which is movably attached to the guiding device. A connection unit couples the bogie to the vehicle by a joint, so that drifting of the vehicle is possible.

18 Claims, 1 Drawing Sheet

TOWING VEHICLE

This application claims priority to EP patent application No. 20193885.9 filed Sep. 1, 2020, the entire contents of which are hereby incorporated by reference.

BACKGROUND OF THE INVENTION

Field of the Invention

The application relates to a system for passenger transport, comprising: a rail-guided drive unit comprising a guiding device and at least one bogie arranged at the guiding device; at least one vehicle with at least one passenger receptacle coupled to and moved by the drive unit on water or in water or on land, wherein the drive unit pulls and/or pushes the vehicle; and a connection unit arranged between the drive unit and the vehicle.

Description of the Related Art

Amusement rides, such as roller coasters, are used in a variety of ways. Amusement rides often comprise rail-guided amusement vehicles, so that their movement and orientation can be controlled in a defined way. The orientation of the vehicle depends on the position of the vehicle on and along the track, and the movement of the vehicle also depends on the speed and acceleration of the vehicle at a given position along the track. The control of speed and acceleration can be accomplished by controlling an appropriate drive system.

There are a variety of drive systems for amusement vehicles, for example chain drives, gear drives, drives with friction wheels, linear drives, or drives having traction rope or a traction belt. Depending on the application, a suitable drive system is used. However, most of the systems described have the disadvantage that they always provide a passenger with the same driving experience and do not allow any influence on the movement of the vehicle.

US 2016/0332084 A1 discloses an amusement ride having a passenger receptacle with four wheels that is rotatably connected to a bogie. The bogie moves on a rail which is located in a gap formed in driving surface, the rail being located below the driving surface. While in this implementation passengers can influence certain aspects of the ride, the overall design is relatively complex. In particular, the system requires bridging the gap in certain driving situations.

SUMMARY OF THE INVENTION

It is an object of the invention to provide a system for passenger transportation having a simple design and allowing flexible and controllable driving situations. The object is solved by a system for transporting passengers.

The system for transporting passengers according to the invention comprises: a rail-guided drive unit comprising a guiding device and at least one bogie arranged at the guiding device; at least one vehicle having at least one passenger receptacle, wherein the vehicle is coupled to the drive unit and is moved by the latter on or in water, or on land, or on a driving surface, the drive unit is configured for at least pulling or pushing the vehicle; and a connection unit between the drive unit and the vehicle. The connection unit is configured in such a way that the vehicle can perform at least one rotational movement relative to the drive unit, so that the vehicle or a part of the vehicle can swing out or drift obliquely or laterally relative to the direction of travel and relative to a track (F) determined by the guiding device.

According to the invention, the drive unit is arranged laterally and/or above the vehicle. At least the bogie and the guide device (rail or rails) are preferably arranged laterally and/or above the vehicle so that, on the one hand, the passengers have a relatively unobstructed view. On the one hand the generally forward-facing viewing direction is not disturbed by the guide device, and, on the other hand, no complicated structural measures are required that would involve a guide device being located underground or below the water surface and a drive unit arranged accordingly thereon. In addition, the driving surface can be designed without interruption, so that constructive measures involving the bridging of gaps and interruptions in the driving surface are also unnecessary. With regard to water vehicles, the possibilities for drives located below the water surface are limited due to the relatively high resistance and moisture.

The system may be used for both land and water vehicles. For land vehicles, a driving surface (e.g. a roadway made of steel plates with relatively low friction) is provided on which a vehicle equipped with wheels can move and also drift. In the case of water vehicles, the vehicle moves on a water surface. The (preferably) rear part of the vehicle can drift or be deflected, when the vehicle is pulled by the bogie Thus the possibilities of movement of the vehicle are relatively variable, since drifting or deflection of a part of the vehicle can generally occur to a greater or lesser extent. The extent of drifting or swinging out of a part (usually the rear part) of the vehicle may, for example, be due to centrifugal forces, which in turn may depend on the speed in a curve and the accelerations induced thereby, or on other factors. Alternatively, or in addition, the extent of drifting or swinging out may be controlled by an external control, for example, by the speed of the vehicle or by steering operations, for example, a steering of the rear axle in the case of land vehicles or by a rudder in the case of water vehicles. The movements of the vehicle may also be influenced by external factors such as loading condition, weight, draught, etc. In particular, it may be envisaged that passengers can interactively control the extent of drifting or swinging out, e.g. by steering or by directly or indirectly influencing the control of the system.

The pivot axis of the drifting or swinging out process is generally oriented perpendicular (or approximately perpendicular) to the driving surface or the water surface. This pivot axis is referred to herein as the z-axis or z-direction. In addition, the pivot axis is oriented perpendicular to the direction of travel (defined as the x-direction). The pivot axis is defined, for example, by a joint arranged at the vehicle. Usually, the swivel axis is located in the front area of the vehicle so that the rear area can swivel out or drift.

The guide unit defines a track along which a vehicle moves. A chassis or bogie connected to the vehicle via the connection unit, which is moved along the guide device, pulls the vehicle located on the ground or on water. The vehicle (land or water vehicle, e.g. in the form of a car or a boat) is a non-rail guided vehicle in the form of a moving passenger carrier. In this context, non-rail guided means that no rail is located directly at or near the vehicle, i.e., not on the driving surface or in the water near the track of the vehicle. Guidance of the vehicle is provided by the guiding device, but indirectly via the connection unit (e.g. arm or boom), which at least allows the vehicle to swivel relative to the guiding device (and thus to deflect with respect to the x-direction).

In particular, the bogie or towing vehicle is located above and/or beside the towed vehicle. For this reason, unlike in conventional systems, there is no need for a gap in the driving surface or roadway that would have to be driven over when the passenger vehicle drifts. Since it is not possible to drive over the gap without problems, the gap usually has to be closed in a technically complex manner. This is not necessary in the present invention. The inventive construction, without a gap, has further advantages, such as better accessibility to the bogie (towing vehicle) for maintenance work, simpler assembly of the system, etc. In addition, the system according to the invention can be used flexibly for land and water vehicles.

Another advantage of the inventive system is that, whereas in conventional systems there is only the possibility of drifting around a (vertical) tow-bar of the connection unit, the inventive system allows deflection of the tow-bar in the y-direction and/or z-direction, so that the possibilities of movement and degrees of freedom of movement of the passenger carrier vehicle increase.

In particular, the connection unit is connected to the bogie which is arranged at the guide device. This connection is usually rigid, but may have elements that are elastic to a flexible to a certain extent.

The connection unit can be designed in such a manner that the vehicle, in addition to rotating about the z-axis, can perform a lateral translational movement oriented transversely or perpendicularly to the direction of travel (y-direction). For example, the connection unit may comprise a telescopic design that allows the vehicle to deviate or veer obliquely from the predetermined track. The predetermined track is determined by the guiding device, but does not correspond to the route of the guiding device. It is rather defined by a constant distance of the track from the guiding device, or by a distance which is dependent on the position of the vehicle along the track. For example, the track may be parallel to the route of the guiding device.

The above-mentioned variants of controlling the movement of the vehicle are also possible for the above-mentioned additional translational movements occur.

In another preferred embodiment of the invention the connection unit can be designed in such a way that the vehicle can carry out translational movement upward and/or downward (z-direction) relative to the driving surface or water surface, the direction of this movement being oriented transversely or perpendicularly to the direction of travel. This movement, defined as the z-direction, can cause the vehicle to jump or lift off the driving surface or the water surface. The z-movements can be used, for example, for jumps of the passenger vehicle (e.g. using jumps). In addition, the possibility of movement in the z-direction may allow compensatory movements in the z-direction, e.g. to compensate for waves in the water or bumps in the driving surface or different water levels.

Both the movement in the y-direction and the movement in the z-direction can be configured as passive movements, e.g. as damping, or as active movements, e.g. driven by hydraulics that may vary a length of a connection arm of the connection unit.

In particular, the connection unit may include an extension arm extending from the bogie towards the vehicle.

In particular, the connection unit is an articulated joint between the vehicle and the bogie. The articulated joint may be arranged at the vehicle, at the connection unit close to the vehicle, and/or at a transverse boom.

In particular, the connection unit has a joint arranged at the vehicle and/or at the transverse boom. The joint must allow at least one rotation about the z-axis, which is oriented perpendicular (or approximately perpendicular) to the driving surface or water surface, in order to allow drifting or swinging out of a portion of the vehicle. In addition, the pivot axis is oriented perpendicular to the direction of travel. The joint may be configured to allow further movement in different degrees of freedom (e.g., rotation about three axes x, y, and z), in order to compensate for rocking of the boat, for example.

The connection unit preferably has at least one arm that extends from above towards the vehicle and is coupled to it. The arm may be telescopic to allow translational movements of the vehicle. The connection unit or the arm may be designed as an extension arm comprising a pull rod.

In particular, the vehicle is pivotally connected to the arm.

It is preferred that the drive unit comprises has a positive-fit (form-fit, positive locking) drive. Positive-fit drives have a stationary engagement element, e.g. a toothed rack or chain, at least along one or more sections of the track, at or near the guiding device. A running gear arranged at the vehicle is equipped with a complementary engagement element, e.g. a gear wheel, which is driven by a motor and engages with the stationary engagement element. Positive drives are very precise, they allow accurate implementation of speed control, and they enable targeted acceleration and deceleration over short distances. However, the invention is not limited to positive-fit drives. Additionally or alternatively other drives may be implemented, e.g. drives with friction wheels, linear drives, drives that comprise traction chains or traction cables, etc.

In particular, the system according to the invention may be configured in such a way that at least one of a deviation from a predetermined track and a swinging movement and a drifting movement of the vehicle is generated due to the accelerations of the vehicle induced by the route of the guidance device.

Alternatively, at least one of a deviation from a predetermined track and a swinging movement and a drifting movement of the vehicle may be generated by an automatic or interactive control device.

In particular, the system may include a control device for interactively controlling the speed of the vehicle by actuation of at least one passenger accommodated in the passenger receptacle. By means of the speed, centrifugal forces in curves are controllable and thus the extent of drifting or swinging or swerving may be influenced.

In a particular embodiment of the invention, the system may comprise a device for limiting the angle of rotation of the drifting or swinging or swerving motion of the vehicle. This device may, for example, comprise a stop that limits the maximum angle of rotation of the swivel joint.

In order to prevent collisions, a minimum distance must be maintained between the supports or beams of the guiding device and the vehicle at a maximum deflection during drifting or swinging. This may be achieved either by means of a sufficiently long transverse arm or cantilever to which a tow-bar is attached and/or by means of supports placed sufficiently far to the side of the track.

BRIEF DESCRIPTION OF THE DRAWINGS

Further features and advantages of the invention will become apparent from the following description of preferred embodiments with reference to the figures. They show.

DESCRIPTION OF THE PREFERRED EMBODIMENTS

Figure 1:
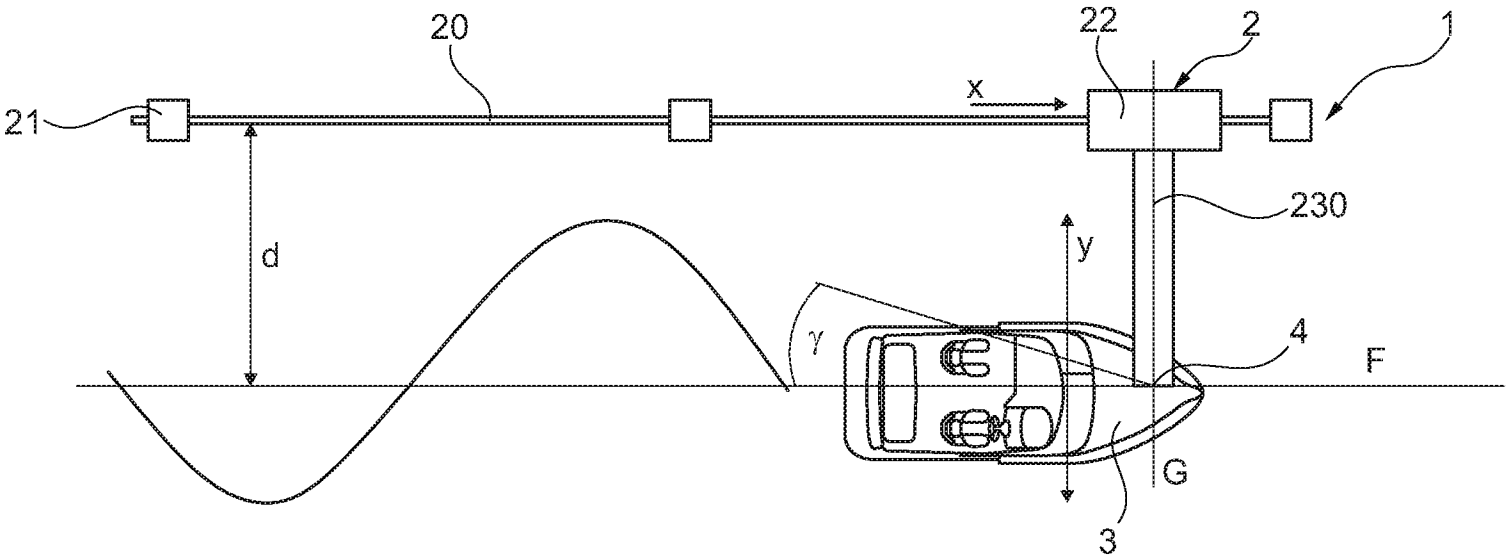
FIG. 1 is a top view of an embodiment of a system for transporting passengers according to the invention.
Figure 2:
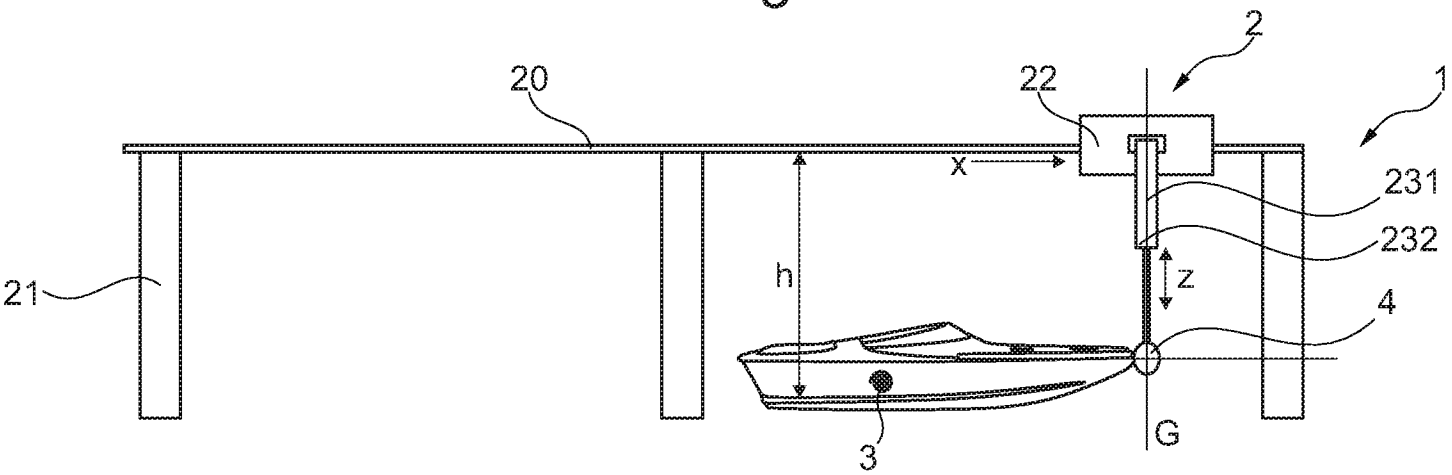
FIG. 2 is a side view of the embodiment of FIG. 1.

FIGS. 1 and 2 show a system 1 according to the invention for transporting passengers, in particular a system which is used as an amusement ride.

The system 1 comprises a drive unit 2 and a water vehicle 3 pulled or towed by the drive unit 2.

The drive unit 2 comprises a stationary guiding device 20, for example in the form of one or more guide rails, which are attached to pillars 21. The guiding device 20 is arranged laterally at a distance d and above at a height h relative to the vehicle 3. The drive unit 2 further comprises a bogie 22, which is attached to the guide device 20 movably in an x-direction (corresponding to the direction of extension of the guide device 20). The bogie 22 is moved along the guide device 20 by a drive (not shown). In particular, the drive may be a positive-fit drive. For this purpose, at least along one or more sections of the route of the guiding device 20, a stationary engagement element, e.g. a toothed rack or chain, is attached to or adjacent to the guiding device 20. The bogie is provided with a complementary engagement element, for example a gear wheel, which is driven by the drive and is in engagement with the stationary engagement element.

The drive unit 2 further comprises a connection unit 23, by means of which the bogie 22 is coupled to the vehicle 3. The connection unit 23 may be, for example, a boom 230 with a vertical tow-bar 231 connected thereto. The boom 230 is rigidly attached to the bogie 22 and the tow-bar 231 is attached to the vehicle 3 by means of a joint 4. In particular, the joint 4, arranged at the front of the vehicle 3, allows drifting (swinging out the rear portion of the vehicle) when appropriate forces are applied to the vehicle 3, whether by centrifugal forces in a turn, or by a control (interactive or pre-programmed) that generates, for example, an instability (e.g., by moving a fin or rudder) that results in skidding, or that generates swinging out by active application of force.

In this embodiment, the vehicle 3 is a boat, but it could as well be a land vehicle that is moved on a driving surface (e.g. steel plates).

In principle, the vehicle 3 is guided along a travel track F, which is defined by a distance d between the guiding device 20 and the vehicle, and runs parallel to the guiding device 20 at the distance d.

Furthermore, the connection unit 23 may be configured in such a way that a deviation from the track F is possible by a movement of the vehicle in y-direction (perpendicular to the direction of travel). The deviation may be induced passively, for example by means of damping or external centrifugal forces, or actively, e.g. by means of an actuating mechanism. The actuating mechanism may be a hydraulic mechanism, for example. The mechanism may comprise a telescopic structure.

Furthermore, the connection unit 23 may be configured to allow deviation from the track by moving the vehicle or part of the vehicle in a z-direction (perpendicular to the direction of travel and perpendicular to the travel surface), that is, upward and/or downward. The deviation may be induced passively, e.g., by means of damping that compensates, for example, for unevenness in the travel surface, reductions in the distance h of the guide device 20 from the travel surface, waves in the case of watercraft, etc. However, movement in the z-direction may also be induced actively, for example by an actuating mechanism. The actuating mechanism may be, for example, a hydraulic mechanism. The mechanism may include a telescoping structure 232. Movements such as a jumping of the vehicle 3 may be generated thereby in a controlled or interactively triggered manner.

Drifting means a swinging out of a part, mostly the rear part, of the boat 3 about the articulation axis G, for example by an angle γ. The angle may be limited by a device for limiting the swinging out, for example to reliably prevent a collision of the swinging out rear part of the boat 3 with a pillar 21.

The invention claimed is:

1. A system for transporting passengers, comprising:

a rail-guided drive unit comprising a guiding device and at least one bogie arranged at the guiding device;

at least one vehicle having at least one passenger receptacle, the vehicle being coupled to the rail-guided drive unit and moved by said drive unit on or in water, or on land, or on a driving surface, wherein said drive unit is configured for at least pulling or pushing said vehicle; and a connection unit between the drive unit and the vehicle, wherein the drive unit including the guiding device and the at least one bogie are arranged above the vehicle, and wherein the connection unit is configured in such a way that the vehicle can perform at least one rotational movement relative to the drive unit, so that the vehicle or a part of the vehicle can swing out or drift obliquely or laterally relative to the direction of travel and relative to a track determined by the guiding device.

2. The system according to claim 1, wherein the connection unit is configured in such a way that the vehicle can perform a lateral translational movement (y) oriented transversely or perpendicularly to the direction of travel.

3. The system according to claim 1, wherein the connection unit comprises a cantilever extending from the bogie towards the vehicle.

4. The system according to claim 3, wherein the connection unit comprises an articulated joint arranged at the vehicle.

5. The system according to claim 1, wherein the connection unit provides an articulated connection between the vehicle and the bogie.

6. The system according to claim 5, wherein the connection unit comprises an articulated joint arranged at the vehicle.

7. The system according to claim 1, wherein the connection unit comprises an arm extending from above towards the vehicle and being coupled to the vehicle.

8. The system according to claim 7, wherein the vehicle is pivotably connected to the arm.

9. The system according to claim 1, wherein the drive unit comprises a positive-fit drive.

10. The system according to claim 9, wherein at least one of a deviation from a predetermined track and a swinging movement and a drifting movement of the vehicle is generated by an automatic or interactive control device.

11. The system according to claim 1, wherein at least one of a deviation from a predetermined track and a swinging movement and a drifting movement of the vehicle is generated due to the accelerations of the vehicle induced by the route of a guidance device.

12. The system according to claim 1, wherein at least one of a deviation from a predetermined track and a swinging movement and a drifting movement of the vehicle is generated by an automatic or interactive control device.

13. The system according to claim 1, wherein the system comprises a control device for interactive control of the speed of the vehicle, wherein the control device is actuated or manipulated by at least one passenger accommodated in the passenger receptacle.

14. The system according to claim 1, wherein the system comprises a device for limiting the angle of rotation of the drift or swing-out movement of the vehicle.

15. The system according to claim 1, wherein the connection unit is configured in such a way that the vehicle carries out a translational movement (z) upward and downward relative to the at least one bogie arranged at the guiding device so that the vehicle lifts off the driving surface.

16. The system according to claim 1, wherein the connection unit is configured in such a way that the vehicle carries out a translational movement (z) upward and downward relative to the at least one bogie arranged at the guiding device so that the vehicle jumps off the driving surface.

17. The system according to claim 1, wherein the connection unit is configured in such a way that the vehicle performs a translational movement (z) oriented transversely or perpendicularly to the direction of travel upwards and/or downwards relative to the guiding device.

18. The system according to claim 17, wherein the connection unit is configured in such a way that the vehicle carries out the translational movement (z) upward and downward relative to the at least one bogie arranged at the guiding device so that the vehicle lifts off the driving surface.

* * * * *